United States Patent [19]

Stevenson et al.

[11] Patent Number: 4,491,472

[45] Date of Patent: Jan. 1, 1985

[54] CARBOTHERMIC REDUCTION AND PREREDUCED CHARGE FOR PRODUCING ALUMINUM-SILICON ALLOYS

[75] Inventors: David T. Stevenson, Washington Township, Armstrong County; Robert L. Troup, Murrysville, both of Pa.

[73] Assignee: Aluminum Company of America, Pittsburgh, Pa.

[21] Appl. No.: 472,670

[22] Filed: Mar. 7, 1983

[51] Int. Cl.[3] ..... C22B 4/00; C22B 21/00

[52] U.S. Cl. ..... 75/10 R; 75/68 R

[58] Field of Search ..... 75/10 R, 11, 12, 68 R

[56] References Cited

U.S. PATENT DOCUMENTS

| | | | |
|---|---|---|---|
| 3,661,561 | 5/1972 | Frey et al. | 75/68 R |
| 3,758,289 | 9/1973 | Wood | 75/10 |
| 4,033,757 | 7/1977 | Kibby | 75/10 R |
| 4,053,303 | 10/1977 | Cochran et al. | 75/68 A |
| 4,162,167 | 7/1979 | Enomoto et al. | 106/44 |
| 4,216,010 | 8/1980 | Kibby | 75/68 A |
| 4,269,620 | 5/1981 | Johansson | 75/11 |
| 4,299,619 | 11/1981 | Cochran et al. | 75/10 R |
| 4,334,917 | 6/1982 | Kibby | 75/10 R |

FOREIGN PATENT DOCUMENTS

| | | |
|---|---|---|
| 56-150141 | 11/1981 | Japan . |
| 56-150142 | 11/1981 | Japan . |
| 56-150143 | 11/1981 | Japan . |

OTHER PUBLICATIONS

"Carbothermic Smelting of Aluminum", P. T. Stroup, *Transactions of the Metallurgical Society of AIME,* Apr., 1964.

"Reaction of Clay and Carbon to Form and Separate $Al_2O_3$ and SiC", B. C. Bechtold and I. B. Cutler, *J. Am. Cer. Soc.* May/Jun. 1980.

"Reductio ad Aluminium", *Far Eastern Economic Review,* Jun. 18, 1982.

*Primary Examiner*—Peter D. Rosenberg

*Attorney, Agent, or Firm*—Douglas G. Glantz

[57] ABSTRACT

Disclosed is a method for the carbothermic reduction of aluminum oxide to form an aluminum alloy including producing silicon carbide by heating a first mix of carbon and silicon oxide in a combustion reactor to an elevated temperature sufficient to produce silicon carbide at an accelerated rate, the heating being provided by an in situ combustion with oxygen gas, and then admixing the silicon carbide with carbon and aluminum oxide to form a second mix and heating the second mix in a second reactor to an elevated metal-forming temperature sufficient to produce aluminum-silicon alloy. The prereduction step includes holding aluminum oxide substantially absent from the combustion reactor. The metal-forming step includes feeding silicon oxide in a preferred ratio with silicon carbide.

30 Claims, 1 Drawing Figure

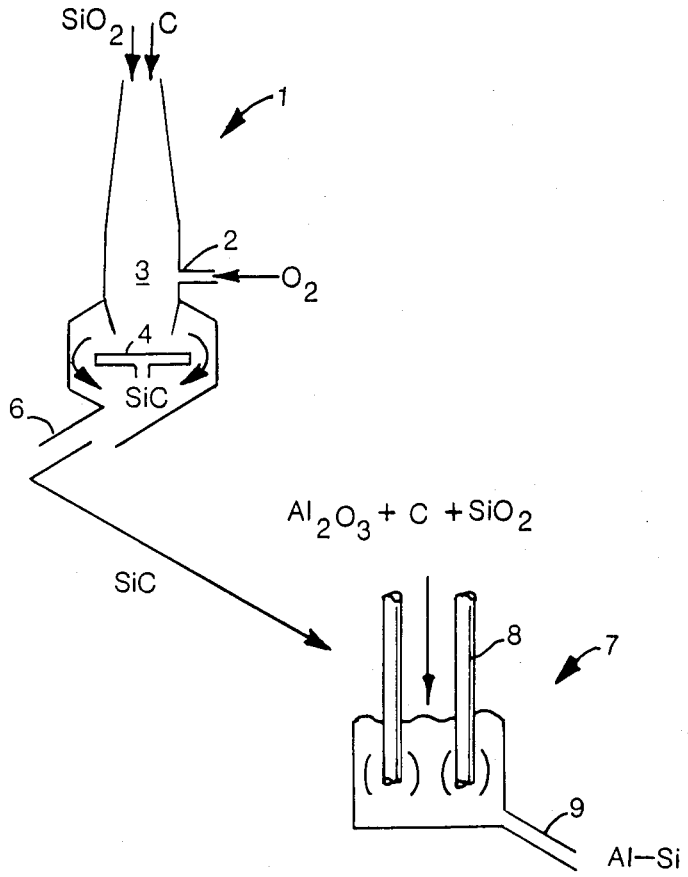
FIGURE

CARBOTHERMIC REDUCTION AND PREREDUCED CHARGE FOR PRODUCING ALUMINUM-SILICON ALLOYS

The Government of the United States of America has rights in this invention pursuant to Contract No. DEAC01-77CS40079 awarded by the Department of Energy.

BACKGROUND OF THE INVENTION

The present invention relates to a method for the carbothermic reduction of aluminum oxide and silicon oxide to form an aluminum alloy wherein at least a portion of the heat required by the process is provided by an in situ combustion with oxygen gas such as in a blast furnace.

The predominant commercial process today for producing aluminum metal is the Hall-Heroult process of electrolytically dissociating alumina dissolved in a fused cryolitic bath at a temperature less than about 1000° C. Many attempts have been made to displace this process and produce aluminum commercially by a direct thermal reduction process of aluminum oxide with carbon at sufficiently high temperatures according to a reaction written as:

$$Al_2O_3+3C \rightarrow 2Al+3CO. \quad (1)$$

However, such a process has presented a substantial technical challenge in that certain difficult processing obstacles must be overcome. For example, at the temperatures necessary for the direct thermal reduction of alumina to form aluminum, e.g., such as about 2050° C., the aluminum volatilizes to a gas of aluminum metal or aluminum suboxide rather than forming as aluminum metal liquid which may be tapped from the process. For this reason, most attempts have incorporated an electrical furnace for the purpose of reducing the amount of volatile gaseous constituents in the system.

Another problem found in attempts to reduce alumina thermally with carbon in the absence of other metals or their oxides shows up in substantial formations of aluminum carbide according to the reaction:

$$2Al_2O_3+9C \rightarrow Al_4C_3+6CO\uparrow \quad (2)$$

which proceeds favorably at or above 1800° C. Other intermediate compounds also are formed such as oxycarbides by the reactions:

$$4Al_2O_3+Al_4C_3 \rightarrow 3Al_4O_4C \text{ and} \quad (3)$$

$$Al_4O_4C+Al_4C_3 \rightarrow 4Al_2OC. \quad (4)$$

These carbides and oxycarbides of aluminum readily form at temperatures lower than the temperatures required for significant thermal reduction to aluminum metal and represent a substantial slag-forming problem in any process intended to produce aluminum. A comprehensive overview of technical attempts to overcome the problems in achieving a process for the thermal reduction of alumina with carbon to form aluminum metal is found in *Carbothermic Smelting of Aluminum,* by P. T. Stroup, Transactions of the Metallurgical Society of AIME, April, 1964.

An early attempt to produce aluminum alloy by carbothermic reduction and to avoid the volatilization problem is represented by the Cowles process, which probably is the first thermal process for the reduction of alumina with carbon that ever reached a commercial stage. The Cowles process used a collector metal of copper added to an alumina-carbon charge in an electric furnace to produce aluminum alloy. However, it was never found economically feasible to remove the copper collector metal from the aluminum alloy produced in the Cowles process.

Thermodynamic calculations and experience have shown that all the major oxides in bauxite except zirconia are reduced by carbothermic smelting before alumina is reduced. In practice, however, the oxides do not behave as simply as predicted. Instead, intermediate compounds are formed such as carbides, oxycarbides, and volatile subcompounds. Nevertheless, it has been recognized that it would be propitious to use a collector metal for promoting the absorption of aluminum vapor set free at the high temperatures required for the reduction reaction, thus preventing loss of aluminum by volatilization and carbide formation, which collector metal could form a commercially desirable alloy with aluminum. Silicon would be one such desirable collector metal since silicon has a higher boiling point, i.e., 3280° C., than copper (2560° C.) as used previously in the Cowles process, and further since silicon oxide, combined with aluminum oxide, occurs in nature in almost unlimited quantities. It has been reported that aluminum-silicon alloys were produced commercially by carbothermic smelting in Germany during World War II at a power consumption of 14 to 16 kw hour per kilogram alloy. The German process used a molten salt bath containing cryolite to refine the furnace alloy and remove carbides, nitrides, oxides, calcium, and magnesium.

The discussion to this point has referred to prior attempts at the direct thermal reduction of alumina with carbon and other compounds incorporating electrical furnace heating as the sole energy source for the purpose of reducing volatilized components including those of aluminum or aluminum suboxide. These processes nevertheless have not overcome problems attributable to the formation of carbides and oxycarbides. Such problems include the formation of reactor-fouling agglomerations and degradation of any metal produced. Kibby, U.S. Pat. No. 4,033,757, U.S. Pat. No. 4,216,010, and U.S. Pat. No. 4,334,917 illustrate the nature of such carbide formation problems and represent various attempts to minimize or cure the effect on aluminum formation.

It has been recognized that a method of making aluminum-silicon alloy in a blast furnace would be commercially desirable by substituting a less expensive combustion heating for the electrical furnace. Frey et al, U.S. Pat. No. 3,661,561, disclose a process for producing aluminum-silicon alloy in a blast furnace using carbon, an alumina-silicon ore, and pure oxygen. According to the patent, oxygen reacts with carbon to form carbon monoxide gas to maintain temperatures in excess of 2050° C. in the reaction zone of the furnace. Silicon carbide lumps are placed in the furnace bed to prevent aluminum carbide or silicon carbide forming with the carbon from the coke in sufficient quantity to be a processing problem. Assuming that the Frey et al process is operative to avoid the formation of carbide and oxycarbide slag in reactor-fouling amounts, Frey et al do not overcome the substantial problem of the formation of volatile components such as aluminum gas and aluminum suboxide gas which will form in the blast furnace disclosed to operate at temperatures in excess of 2050° C. moreover, Frey et al do not disclose the method for forming silicon carbide.

The Atcheson process represents the principal commercial method for manufacturing silicon carbide from a mixture of sand and coke in an electrically resistance-heated batch-type operation. The Atcheson process is highly intensive in both labor and electrical energy.

Enomoto, U.S. Pat. No. 4,162,167, discloses a continuous process for producing silicon carbide from silica and carbon by heating to a temperature of 1600°-2100° C. in an electrical furnace.

Johansson, U.S. Pat. No. 4,269,620, discloses a process for producing silicon by reducing silicon oxide through an intermediate silicon carbide. Electrical energy is used to generate silicon suboxide gas which in a preheat zone reacts with carbon to form the silicon carbide.

Bechtold and Cutler, "Reaction of Clay and Carbon to Form and Separate $Al_2O_3$ and SiC," *J. Am. Cer. Soc.*, May-June 1980, disclose producing alumina and silicon carbide from clay by carbon reduction proceeding through intermediates of CO and SiO. Bechtold et al employ temperatures up to 1505° C. by an electrically heated furnace.

Others have recognized the desirability of substituting a blast furnace energy source for electrical heat in the formation of the silicon carbide. Attempts also have been made to combine a staged silicon carbide formation with and as part of an attempt at carbothermically reducing alumina and silica with carbon. For example, Wood, U.S. Pat. No. 3,758,289, discloses the prereduction of an alumina-silica ore which is then thermally smelted in an electric arc furnace. No attempt is made in Wood to separate alumina from the alumina-silica silica ore prior to prereduction, and alumina thereby is present in the process disclosed to reduce the silica in the ore to silicon carbide. Prereduction is carried out at approximately 1500°-1800° C., and preferably at a temperature in the range of 1600°-1700° C.

Cochran, U.S. Pat. No. 4,053,303, discloses a process where the prereduction step of forming silicon carbide from alumina, silica, and carbon is carried out as a first stage in a multistage reactor. Prereduction to form silicon carbide is disclosed at a temperature in the range of 1500°-1600° C. The ore is processed through subsequent continuous stages, either in a blast furnace or electric furnace with the blast furnace technique being preferred because of economics, to form an aluminum-silicon alloy.

Any attempt to substitute a blast furnace for an electrical furnace in an attempt to reduce an aluminum-silicon ore by carbothermic techniques must first overcome problems associated with the volatilization of the desired products, which volatilization is detrimentally encouraged by the gases formed in the blast furnace.

One direction taken to reduce the volatility problem is found in Cochran et al, U.S. Pat. No. 4,299,619. Cochran et al disclose a process utilizing a two-zone reactor, wherein the first zone is heated to a reaction temperature of about 2050° C. by the internal combustion of carbon and the second or lower zone is heated electrically to a temperature of about 2100° C. Alumina and carbon are inserted to the upper zone and reacted at an elevated temperature to form CO and a first liquid of alumina and aluminum carbide. The first liquid is then transferred to a lower reaction zone beneath the upper reaction zone and heated to form CO and a second liquid of aluminum and carbon. Oxygen is added to preheat reactants in the upper zone and to maintain a desired reaction temperature. The lower zone is electrically heated by an electric resistance heater or alternative heat sources such as an electric arc or other heat sources not producing large volumes of gas.

Kuwahara has filed disclosure Nos. 56-150141, 56-150142, and 56-150143 with the Japanese Patent Agency disclosing a smelting method of aluminum by reduction in a blast furnace using oxygen injecting tuyeres to achieve temperatures in the range of 2000°-2100° C. at the tuyere level of the blast furnace. An article entitled "Reductio ad aluminium, "*Far Eastern Economic Review*, June 16, 1982, at page 63, inexplicably refers to the Kuwahara process as charging aluminous ore briquettes into a blast furnace heated by an electric arc and the combustion of coke in the presence of oxygen in air to sustain temperatures of 2000° C. Notwithstanding this inexplicable mention of the use of electric arc and the combustion of coke, the Kuwahara patent application disclosures nowhere suggest the use of a blast furnace heated by an electric arc. The *Far Eastern Economic Review* article must be characterized as far from an enabling disclosure. The Kuwahara process employs a molten lead spray splashed into the furnace at 1200° C. to scrub and absorb molten metal product at the bottom of the furnace.

Despite a considerable technical effort expended in the attempt to achieve a process for the production of aluminum and silicon alloy by the direct reduction of aluminum oxide and silicon oxide raw materials, processes disclosed to date have been unsuccessful in substituting combustion heating for the electrical furnace. Such a process for employing less expensive and more efficient combustion heating while overcoming the significant problems of product volatilization and reactor-fouling slag formation has been unavailable until now.

SUMMARY OF THE INVENTION

In accordance with the present invention, a process has been discovered and is disclosed herein to provide a method for the carbothermic reduction of aluminum oxide to form an aluminum alloy including producing silicon carbide by heating a first mix of components including carbon and silicon oxide in a combustion heated reactor to an elevated temperature sufficient to produce silicon carbide at an accelerated rate, wherein the first mix heating is provided by an in situ combustion with oxygen gas; and then admixing silicon carbide with carbon and aluminum oxide to form a second mix and heating the second mix in a second reactor to an elevated metal-forming temperature sufficient to produce aluminum-silicon alloy. The process of the present invention encompasses such a method of carbothermic reduction which further includes holding aluminum oxide substantially absent from the prereduction step in the combustion reactor. The present invention further includes a process as stated above wherein the silicon oxide in proper proportions to silicon carbide is fed to the second reactor along with carbon and aluminum oxide and heating the second reactor so charged to an elevated metal-forming temperature to produce aluminum-silicon alloy.

BRIEF DESCRIPTION OF THE DRAWING

The FIGURE is a schematic illustrating the process of the present invention as carried out in a combustion reactor and a separate electrical furnace.

DETAILED DESCRIPTION

A combustion heated process for carbothermically smelting an aluminum oxide and silicon oxide to form an aluminum-silicon alloy cannot be visualized merely as an iron blast furnace-type reactor modified for higher temperature operation and injection of $O_2$ instead of air. For reactions occurring in a packed bed of ore and coke with countercurrent flow of carbon monoxide gas generated by burning coke in the combustion zones located in front of oxygen injecting tuyeres, and generated as a product of reduction reactions, a number of significant differences exist between iron and aluminum-silicon production processes.

Temperatures for aluminum-silicon alloy formation by the direct thermal reduction of alumina and silica are much higher than those in an iron smelting process, e.g., minimum temperatures of about 2000° C. for aluminum-silicon alloy compared to about 1500° C. for iron. Since less heat is available from combustion when the heat must be supplied at a higher temperature and since aluminum-silicon smelting is much more endothermic than that for iron, the fuel rate for aluminum-silicon smelting is expected to be much higher than for iron smelting.

Thermodynamics show that carbon monoxide can reduce $Fe_2O_3$, but CO cannot reduce $SiO_2$ or $Al_2O_3$. Direct reduction by carbon is required. For aluminum-silicon smelting, a ratio of $CO_2/CO$ is about zero assuming negligible Boudouard reaction, while for iron smelting the $C0_2/CO$ approximates one. Therefore, reduction reactions in the carbothermic reduction of aluminum oxide and silicon oxide alone result in greater gas volumes consisting of primarily CO.

The reduction reactions to form aluminum and silicon from aluminum oxide and silicon oxide proceed by gaseous intermediates as opposed to a simple gas-solid reaction between CO or $H_2$ and $Fe_2O_3$ to produce Fe and $CO_2$ or $H_2O$. The refluxing species Al, $Al_2O$, and SiO back react with CO at lower temperatures, forming deposits which cause reactor-fouling agglomerations resulting in bridging. The charge tends to become cemented together and solids flow is held up. Although SiO may cause problems in a ferrosilicon or ferromanganese blast furnace, reflux of alkalis rather than suboxides can cause similar problems in a normal iron blast furnace. As reflux increases, the shaft behaves as a heat pipe which absorbs heat at high temperatures and liberates heat at low temperatures, resulting in increases in fuel rate and high off-gas temperatures.

Excess carbon in contact with aluminum-silicon alloys at alloy-formation temperatures can cause rapid carbide formation which prevents recovery of the alloy. As to the iron blast furnace, however, liquid iron containing about 4.5% C is in equilibrium with carbon at normal blast furnace temperatures. The carbon content of aluminum-silicon alloys, on the other hand, is an anomalous function of composition and temperature.

Thermodynamically, the standard free energy of oxide formation with respect to temperature indicates that carbon reduces alumina and silica at about 2000° C. and about 1540° C., respectively. However, the presence of stable suboxides, oxycarbides, carbides, and vapors in a system of Al—Si—O—C at high temperatures must be recognized, and many species must be considered in a calculation of equilibrium products. Using recent $Al_2O$ data and assuming an ideal solution behavior of any aluminum-silicon alloy produced, thermodynamic calculations indicate that the production of aluminum-silicon alloy from a raw material charge of alumina, silica, and carbon in a process heated exclusively by combustion heating in situ, i.e., such as in the form of a blast furnace, probably is not feasible. However, such a conclusion is based on assumptions and data having an uncertainty sufficiently large that technical feasibility cannot be ruled out on the basis of thermodynamic calculations alone.

Nevertheless, it has been found from actual observation that severe reactor-fouling agglomerations and bridging problems occur when smelting aluminum oxide and silicon oxide ores together in one reactor. The problems are directly attributable to refluxing of the vapor as metal and suboxide species. It has been found that the substitution of in situ combustion heat for a portion of electrical heat at different levels in one reactor causes virtually insurmountable problems of reactor-fouling attributable to bridging and slag formation around the combustion heat zone. One reason this occurs is the fact that combustion heat produces a very high temperature in the zone of combustion, especially with combustion in an atmosphere rich in oxygen. These temperatures in the case of in situ combustion heat by combustion of carbon with essentially pure oxygen typically are in the range of 3500°–4000° C. Such high temperatures in a reactor combustion zone located to provide unilateral combustion heating and containing alumina, silica, and carbon have been found to cause considerable bridging and slagging problems which usually are substantial enough to shut down the reactor.

In accordance with the present invention, a process has been discovered and is herein disclosed for providing combustion heat to be utilized for only a part of the high temperature heat required in the formation of aluminum-silicon alloy from aluminum oxide and silicon oxide by carbothermic direct reduction. Gaseous sweep rate, including CO sweep rate, through the metal-forming reactor is held sufficiently low to avoid transporting aluminum and silicon from the reaction zone. Not only can combustion heat be utilized at a temperature lower than alloy formation temperature, but also combustion heat is utilized in a reactor entirely separate from the alloy-forming reactor. Moreover, the process of the present invention has been found to provide surprising efficiency in terms of enhanced reaction rates. The present invention also provides a process for producing aluminum-silicon alloy in a reactor fed with a prereduced charge of silicon carbide and silicon oxide in a molar ratio within a defined range along with carbon and aluminum oxide to provide an unexpected improvement in the formation of aluminum-silicon alloy metal.

It is an object of the present invention to provide a method of carbothermic reduction of aluminum oxide to form an aluminum alloy including producing silicon carbide by heating a mix of carbon and silicon oxide by in situ combustion with oxygen gas to an elevated temperature sufficient to produce silicon carbide at an accelerated rate, and then mixing the silicon carbide with carbon and aluminum oxide in a second reactor and heating to an elevated metal-forming temperature sufficient to produce aluminum-silicon alloy.

It is an object of the present invention to substitute combustion heating for electrical heating while minimizing detrimental volatilization of metal and metal suboxide.

It is an object of the present invention to substitute combustion heating for electrical heating in a process for the carbothermic reduction of aluminum oxide to aluminum while minimizing the formation of reactor-fouling bridging.

These and other objects will become apparent from the drawing and from the detailed description which follows.

Referring now to the FIGURE, a schematic diagram is depicted in which silicon oxide, such as silica in the form of quartz, and carbon such as in the form of briquettes of pitch and petroleum coke or lumps of metallurgical coke are fed to the top of combustion reactor 1 to form a gravity-fed moving bed. Sufficient carbon is fed to satisfy the reduction and heating requirements. Oxygen gas is injected through tuyere 2. By the time the mix of silicon oxide and carbon reaches tuyere 2 the silicon oxide will have been reduced to silicon carbide and coke converted to SiC by SiO in the gases rising in the reactor. Heat is provided in combustion zone 3 by an in situ combustion of a portion of the silicon carbide and unreacted coke not converted to SiC with oxygen injected through tuyere 2 to form SiO gas and CO gas. By in situ combustion heating is meant a direct heating by the hot gases produced by combustion of SiC and carbon with oxygen, which combustion usually takes place in the reaction zone to be heated. SiO gas rises in the reactor. SiO gas and $SiO_2$ in the charge react with carbon to form silicon carbide. Silicon carbide is formed in sufficient amount such that not all reacts with oxygen and a portion of the silicon carbide advances through the reactor and, after passing support grate 4, can be withdrawn at bottom 6 of reactor 1. Carbon monoxide gas exiting the top of reactor 1 can be refluxed (not shown) to reactor bottom 6 and passed in countercurrent heat exchange with silicon carbide product, thereby cooling silicon carbide and retaining heat to the reactor.

The process can be balanced by controlling carbon and oxygen feed rates, the solids' discharge rate, and the temperature, so that all carbon is converted to silicon carbide above the combustion zone 4. Preferably reactor 1 is operated as a gravity-fed, moving bed reactor. For this reason the feed materials in solid form should have sufficient structural integrity and strength to hold up in such a moving bed.

Silicon carbide withdrawn from reactor bottom 6 is mixed with aluminum oxide and carbon and charged to the top of reactor 7 which preferably is an electrically heated furnace. Reactor 7 may be heated by a submerged arc or alternative electrical methods provided that the heating means do not introduce substantial additional volumes of gas to the reactor. Electrodes 8 provide heating by submerged arc. Aluminum-silicon alloy is tapped at port 9.

Combustion reactor 1 is heated to a temperature higher than 1800° C. It has been found that such a temperature provides for the production of silicon carbide at an accelerated rate. In this way the combustion reactor produces silicon carbide by heating a first mix of carbon and silicon oxide to a temperature greater than 1800° C. to produce silicon carbide at an accelerated rate. More preferably, the combustion reactor is operated at a temperature exceeding 2000° C.

The metal-forming reaction in reactor 7 is conducted at a temperature in the range of about 2000°-2400° C. and preferably in the range of about 2000°-2100° C. to reduce aluminum vapor losses.

Oxygen injected through tuyere 2 to combustion reactor 1 may be preheated to attain sufficiently high reaction temperatures with less oxygen gas and combustion of a smaller portion of the SiC and unreacted coke quantities introduced to the combustion zone 3. Tuyere 2 may be replaced by a burner and in such an embodiment, the combustion carbon may be injected through the burner. In the burner case, only the carbon for reduction in the form of coke briquettes or metallurgical coke is fed to the top of reactor 1 along with quartz and combustion of SiC does not occur.

An atmosphere rich in oxygen is preferred, e.g., over air, to achieve the high temperatures required in the combustion reactor. Furthermore, it has been found that the use of air produces undesirable nitride formation. For these reasons, it is preferred to use an atmosphere rich in oxygen gas containing at least about 90% by volume oxygen gas, and more preferably containing essentially pure oxygen gas, i.e., at least about 98% by volume oxygen gas.

It has been found that the process of the present invention unexpectedly produces more metal when silicon oxide is fed to the metal-forming reactor along with the prereduced charge of silicon carbide and aluminum oxide and carbon. Moreover, it has been found that the process produces unexpected improvement in the quantity of metal produced when silicon carbide and silicon oxide are fed to the metal-forming reactor in a molar ratio of less than about 4/1. This ratio can be achieved by operating reactor 1 at a lower fuel rate so that less than 100% of the $SiO_2$ is reduced to SiC.

The silicon oxide used in the process for SiC production can be a silica such as quartz or sand, but preferably is quartz which has a larger material particle size than sand to prevent fluidization by the rising combustion gases. Quartz fed to the top of combustion reactor 1 preferably has a particle size in the range of about from $\frac{1}{4}$ inch to $\frac{5}{8}$ inch.

Carbon can be fed to the combustion reactor in an amount ranging from about 8 to 14 mols of carbon for each mol silica. The excess carbon above the 3 mols required for reduction is used for combustion to heat the process and to enhance reaction rate. Below about 8 mols carbon to each mol silica, excess $SiO_2$ occurs in the reactor product. On the other end of the range, i.e., above 14 mols carbon to each mol silica, excess C occurs in the reactor product or excess heat is produced and carbon is wasted. Moreover, carbon fed to the reactor in an amount ranging from about 10 to about 12 mols of carbon for each mol of silica is preferred. The preferred range provides minimum fuel rate, and an enhanced control of the product composition.

Aluminum-silicon alloy is produced from the metal-forming reactor in a ratio in the range of about 40/60 to 70/30 by weight. Each extreme would result in very low metal yield.

The mix of reactant charge fed to the metal-forming reactor preferably consists of lumps comprising a first lump of silicon carbide, a second lump of silica, and a third lump composed of finely divided alumina and carbon. The first lump of silicon carbide, the second lump of silica, and the third lump of finely divided alumina and carbon can have a particle size in the range of from about $\frac{1}{4}$ inch to $\frac{5}{8}$ inch.

In the case for 100% prereduced charge, the mix fed to the metal-forming reactor should have a composition in the range of about from 46.6 to 63.3% aluminum oxide, about from 52.8 to 20.5% prereduced charge of silicon carbide, and from about 0.6 to about 16.2% carbon by weight. For less than fully prereduced charge, the mix fed to the metal-forming reactor should have a composition in the range of about from 40.8 to 60.9% aluminum oxide, about from 37.0 to 15.8% prereduced charge of silicon carbide, about from 13.9 to 5.9% silicon oxide, and from about 8.3 to about 17.4% carbon by weight. These ranges of charge composition for 100% prereduced and less than 100% mixes reflect the burden required to produce aluminum-silicon alloys in a ratio in the range of about 40/60 to 70/30 by weight respectively.

As has already been mentioned, the silicon carbide and silicon oxide preferably are present in a molar ratio of less than about 4/1. This silicon carbide/silicon oxide molar ratio preferably is in the range of 4/1 to 1/1.

Further advantages of the process of the present invention will become apparent from the following examples.

EXAMPLE 1

Carbon and silica at a composition ratio, physical form, and particle size as indicated in Runs 1 and 2 in Table I were fed to a low bed isothermal batch reactor and heated to an elevated temperature sufficient to form silicon carbide. Reaction rates were determined.

In this first example, pellets of coking coal and fused silica were calcined to give a coked $SiO_2$ burden Pellets of two different $C/SiO_2$ mol ratios were tested at 1700° C. Reaction rates were determined for a $C/SiO_2$ mol ratio of 3/1 (Run 1) representing just enough carbon for SiC formation and a ratio of 10/1 (Run 2) which represented sufficient carbon for supplying the heat for SiC formation by in situ combustion with oxygen injected through a tuyere. Data and results are shown in Table I.

Pellets with $C/SiO_2$ of 3/1 reacted at a slower rate than for the $C/SiO_2$ 10/1 pellets at the same temperature.

The reaction rates were determined in the reactor of Example 1 and are shown in Table I.

A dramatically higher reaction rate was observed for SiC formation at the higher temperature.

EXAMPLE 3

SiO gas was produced through an SiO generator by reacting $SiO_2$ and carbon powders in a 1 to 1 molar ratio in the bottom of an isothermal batch reactor. The SiO gas passed up a grate and was reacted to SiC in a bed of carbon. Two different bed carbons were tested, coke (Run 5) and charcoal (Run 6). See Table I. Activated coke and charcoal each were sized to "4+6 mesh. Silicon monoxide was passed up through the bed of carbon which filled the reactor. The bed contained 2 mols of carbon for each mol SiO generated per unit of operating time. SiO was provided through an SiO generator at a temperature of 1775° C. (Run 5 and Run 6) and at 2150° C. (Run 7).

The mixture of Run 5 reacted very slowly and eventually decreased to very low levels. A fused mass formed in the generator. Charcoal was used in the bed in Run 6 to raise the reactivity of the carbon, but the results were similar to coke. Run 7 was quite successful with the $SiO_2$ and C raw materials being totally reacted and the bed containing only SiC. The reaction rate at 2150° C. was dramatically high compared to the other runs at lower temperatures.

EXAMPLE 4

Alumina, silicon carbide, and petroleum coke were fed to a countercurrent shaft reactor operating as a metal-forming reactor having electrical induction heating. Silicon carbide produced in a separate step was crushed and ground and formed into a pellet with powdered activated alumina and coke. Activated alumina served as a binder for the pellets used in the run. A first run (Run 11, Table II) tested the metal production of aluminum-silicon alloy from a burden containing silicon carbide, alumina, and most of the required reduction carbon in one aggregate, i.e., in other words, a one lump burden. The burden was reacted for 160 minutes at a temperature of 2035° C.

A second one lump burden test was run using non-prereduced $SiO_2$, i.e., the charge fed to the reactor consisted essentially of $SiO_2$ with $Al_2O_3$ and carbon. Results are shown as Run 12 in Table II.

TABLE I

Reaction Rate for Producing Prereduced SiC From Silica and Carbon

| Run | Carbon/$SiO_2$ (mol/mol) | Form | Particle Size | Reduction Temperature (°C.) | Time Above 1500° C. (mins.) | Reaction Rate $\frac{\text{mols SiC}}{\text{cm}^3\text{ min.}}$ ($\times 10^{-5}$) |
|---|---|---|---|---|---|---|
| 1 | 3/1 | Pellet | −⅜" + 6 mesh | 1700 | 215 | 3.4 |
| 2 | 10/1 | Pellet | −⅜" + 6 mesh | 1700 | 92 | 6.6 |
| 3 | 3/1 | Lumps | −10 + 20 mesh | 1775 | 373 | 2.2 |
| 4 | 3/1 | Lumps | −10 + 20 mesh | 2150 | 95 | 8.8 |
| 5 | 3/1 | $SiO_2$ + C powders through SiO generator | activated coke bed −4 + 6 mesh | 1775 | 230 | Failed |
| 6 | 3/1 | $SiO_2$ + C powders through SiO generator | charcoal bed −4 + 6 mesh | 1775 | 150 | Failed |
| 7 | 3/1 | $SiO_2$ + C powders through SiO generator | charcoal bed −4 + 6 mesh | 2150 | 85 | 16.1 |

EXAMPLE 2

A set of reactant materials was formed of lumps of quartzite and metallurgical coke having a particle size of −10+20 mesh (Tyler Series) and was reacted at temperatures of 1775° C. (Run 3) and 2150° C. (Run 4).

A third one lump burden test was run on a burden which had been partially reduced to 51.2% SiC. Results are shown as Run 13 in Table II.

Substantially more metal and much less slag and carbide were produced in Run 13 using 51.2% prereduced $SiO_2$ compared to the 100% prereduced charge of Run 11. The operation of this Run 13 produced a bed which was easily maintained above the hot zone to effect reflux.

A bed of solids above the metal-producing zone was difficult to maintain in Run 11 except by an increase of 80% over the feed rate for a similar burden of $SiO_2$ rather than SiC. The useful power input above the power required to supply the reactor heat losses had to be increased by about 90% to reach or maintain metal-producing temperature of 2035° C. However, the product of Run 11 contained only 4% metal, with 44% carbide and 52% $Al_2O_3$ indicating mostly slag rather than metal produced. The comparable Run 12 using fused silica rather than SiC produced normal quality metal with a minor amount of slag in the bottom of the ingot.

TABLE II

| | Metal Production and Prereduced Burden | | |
|---|---|---|---|
| Run | 11 | 12 | 13 |
| $SiO_2/Al_2O_3$ Wt. Ratio | .63 | .61 | .56 |
| Prereduced Charge (molar) | 100% SiC | None (100% $SiO_2$) | 51.2% SiC |
| Wt. % $Fe_2O_3$ | — | — | 1.5 |
| Time >2000° C. minutes | 160 | 180 | 260 |
| Time of CO Evolution minutes | 250 | 255 | 320 |
| $T_{max}$ °C. | 2035 | 2030 | 2050 |
| Average Product Analysis wt. basis | | | |
| % Al | 39.0 | 60.9 | 67.5 |
| % Si | 23.9 | 29.6 | 23.2 |
| % Fe | .3 | .05 | 2.5 |
| % Ti | .05 | .05 | 1.4 |
| % O | 24.7 | 1.3 | .9 |
| % C | 12.7 | 5.9 | 4.9 |
| Al Yield gm | 297 | 1089 | 1037 |
| Si Yield gm | 631 | 543 | 362 |
| Actual Wt. Metal / Max. Wt. Metal | .24 | .65 | .47 |

EXAMPLE 5

The metal-forming reaction step was further investigated in a pilot submerged arc reactor with prereduced burden. Run 21 consisted of a clay/alumina/metallurgical coke pellet which had been prereduced to a level of 75% SiC. Results and data are shown in Table III.

Metal was produced and tapped from the reactor, but it was evident from the poor cavity formation that the submerged arc was not operated properly.

EXAMPLE 6

Runs 22 and 23 in the submerged arc pilot reactor used a pellet made from activated alumina, SiC, and metallurgical coke. Results and data are shown in Table III.

The runs simulated a 100% prereduction of silica to SiC. Only slag was removed from the unit.

TABLE III

| | Metal Production and Prereduced Burdens | | |
|---|---|---|---|
| Run | 21 | 22 | 23 |
| Submerged Arc | | | |
| Initial Volts | 64 | 28 | 65 |
| Amps | 1650 | 1800 | 1800 |
| Final Volts | 80 | 32 | 75 |
| Amps | 1100 | 1550 | 1400 |
| Pellet | Alumina-clay-met. coke | Activated alumina SiC-met. coke | Activated alumina SiC-met. coke |
| Prereduction (molar %) | 75 | 100 | 100 |
| Si/Al | .53 | .48 | .48 |
| Total Run Time | 3 hrs. 20 min. | 3 hrs. | 2 hrs. 18 min. |
| Total Metal Tapped | 4790 g | None (2785 g slag) | None |

Surprisingly, it appears from experimental observation that no fully prereduced burdens could be processed to form aluminum-silicon alloy in a submerged arc furnace, yet partially prereduced burdens having varying $SiC/SiO_2$ ratios along with unprereduced burdens resulted in successful metal production. An explanation, though the scope of the claims of the present invention should not be limited thereby, hypothetically is found in the concept that the conversion of silicon oxide to silicon carbide has a critically important role in the rate of aluminum carbide and oxycarbide slag formation. If the reaction of silicon oxide to silicon carbide is delayed until the temperature of the moving bed approaches 1900°–2000° C., silicon carbide formation will compete with the slag production reactions for the available heat and reduction carbon at that place in the moving bed. Since the endothermic heats of reaction for forming SiC, $Al_4O_4C$, and Al-Si alloy are roughly in the ratios of 35%: 15%:50%, the heat transfer limitations apparently affect these reactions. If half the SiC and all the $Al_4O_4C$ were forming at the same temperature, an equal competition would exist for the available heat to sustain the formation of each and slow down slag formation. If heat and reactants are supplied at ratios sufficient to make metal, and slag production must precede metal production, the latter could only occur if the feed rate of reactants balanced the rate of metal production.

In the case of a metal-forming step using a prereduced charge of silicon carbide in lieu of silicon oxide along with alumina and carbon in a separate reactor, the lack of a silicon carbide reaction in the heat sink which it causes has important implications on the temperature profile in the bed. In this way, a preferred charge to the metal-forming reactor includes a molar ratio of silica to prereduced charge of silicon carbide in the range of from about $\frac{1}{4}$ to about 1/1. The higher limit is important such that a portion of that charge can be prereduced in a combustion reactor thereby providing an economical process which is less expensive than the use of 100% electrical energy. The lower limit importantly must be observed in order to avoid reactor-fouling slag formation. In other terms, the silica introduced to the metal-forming reactor should be prereduced to silicon carbide in an amount at least 50% and no more than 80%. A preferred range for such prereduction of silica to silicon carbide includes a range of from about 50% to 75% of the silica to be introduced as prereduced charge of silicon carbide.

What is claimed is:

1. A method of carbothermic reduction of aluminum oxide to form an aluminum alloy, comprising:

(a) producing silicon carbide by heating a first mix comprising carbon and silicon oxide in a combustion heated reactor to an elevated temperature by in situ combustion with an atmosphere rich in oxygen gas to produce said silicon carbide at an accelerated rate; and (b) then admixing said silicon carbide with carbon and aluminum oxide to form a second mix and heating said second mix in a second reactor to an elevated metal-forming temperature sufficient to produce aluminum-silicon alloy.

2. A method according to claim 1 wherein said aluminum oxide is substantially absent from said combustion reactor.

3. A method according to claim 1 wherein said first mix consists essentially of carbon and said silicon oxide.

4. A method according to claim 2 further comprising admixing said silicon oxide in said second mix.

5. A method according to claim 4 wherein said silicon carbide to silicon oxide are present in said second mix in a molar ratio of less than about 4/1.

6. A method according to claim 5 wherein said silicaon carbide to silicon oxide molar ratio falls within the range of about 4/1 to 1/1.

7. A method according to claim 6 wherein said heating the second mix comprises heating in an electrical furnace.

8. A method according to claim 7 wherein said heating in the combustion reactor comprises charging said first mix into said combustion reactor in agglomerate form and injecting oxygen through a tuyere.

9. A method according to claim 7 wherein said heating in the combustion reactor comprises charging carbon and oxygen through a burner.

10. A method according to claim 7 wherein said electrical furnace comprises a submerged arc.

11. A method according to claim 7 wherein said electrical furnace comprises a plasma torch using carbon oxide gas.

12. A method according to claim 7 wherein said silicon oxide comprises silica and said aluminum oxide comprises alumina.

13. A method according to claim 12 wherein said heating said first mix comprises heating to a temperature above 1800° C. to form silicon carbide.

14. A method according to claim 13 wherein said heating said first mix comprises heating to a temperature above 2000° C. to form silicon carbide.

15. A method according to claim 13 wherein said heating to an elevated metal-forming temperature comprises heating to a temperature in the range of about 2000°-2400° C.

16. A method according to claim 15 wherein said heating to an elevated metal-forming temperature comprises heating to a temperature in the range of about 2000°-2100° C.

17. A method according to claim 16 wherein said heating the first mix comprises feeding carbon to said combustion reactor in an amount ranging from about 10 to 12 mols carbon to each mol silica in said first mix.

18. A method according to claim 16 wherein said silica comprises quartz or sand.

19. A method according to claim 16 wherein said alloy comprises aluminum-silicon in a ratio in the range of about 40/60 to 70/30 by weight.

20. A method according to claim 19 wherein said second mix consists of lumps comprising a first lump of silicon carbide, a second lump of silica, and a third lump composed of finely divided alumina and carbon.

21. A method according to claim 20 wherein said first lump has a particle size in the range of about $\frac{1}{4}$ to $\frac{5}{8}$ inch, said second lump has a particle size in the range of from about $\frac{1}{4}$ to $\frac{5}{8}$ inch and said third lump has a particle size in the range of from about $\frac{1}{4}$ to $\frac{5}{8}$ inch.

22. A method according to claim 21 wherein said second mix is composed from about 15.8 to 37.0% of said first lump, 5.9 to 13.9% of said second lump, 49.1 to 76.1% of said third lump, and 0 to 2.2% by weight of a fourth lump comprising carbon.

23. A method according to claim 19 wherein said heating said first mix comprises feeding quartz having a particle size greater than about $\frac{1}{4}$ inch and carbon in the form of coke briquettes or metallurgical coke into said combustion reactor in a mol ratio of $SiO_2/C$ in the range of from about 10/1 to 12/1.

24. A method according to claim 19 wherein said combustion reactor and said second reactor each comprise a separate gravity-fed, moving bed reactor.

25. A continuous carbothermic reduction process for producing an aluminum alloy comprising:

(a) feeding carbon and a silicon oxide into the top of a combustion reactor;

(b) feeding diatomic oxygen gas to said combustion reactor;

(c) heating said combustion reactor by a burning with said oxygen gas to a temperature sufficient to produce silicon carbide at an accelerated rate by carbothermically reducing said silicon oxide;

(d) withdrawing said silicon carbide from said combustion reactor;

(e) feeding carbon, an aluminum oxide, said silicon oxide, and said silicon carbide to a second reactor; and (f) heating said second reactor to a metal-forming temperature to produce an aluminum-silicon alloy.

26. A method according to claim 25 wherein said aluminum oxide is substantially absent from said combustion reactor.

27. A method according to claim 25 wherein said feeding carbon and silicon oxide to the combustion reactor comprises feeding a mix consisting essentially of carbon and silicon oxide.

28. A method according to claim 26 wherein said feeding said silicon oxide and said silicon carbide to the second reactor comprises feeding said silicon oxide and silicon carbide in the molar ratio in the range of from about $\frac{1}{4}$ to 1/1.

29. A method according to claim 28 further comprising preheating said oxygen gas prior to said feeding to the combustion reactor.

30. A continuous carbothermic reduction process for producing aluminum-silicon alloy comprising:

(a) feeding carbon and silica into the top of a gravity-fed, moving bed combustion reactor;

(b) heating said carbon and silica substantially in the absence of alumina in said reactor to a temperature above 1800° C. by in situ combustion with essentially pure oxygen gas to produce silicon carbide;

(c) withdrawing silicon carbide from the lower portion of said combustion reactor;

(d) charging said silicon carbide as a prereduced charge with said first metal oxide in a molar ratio of from about 4/1 to 1/1 along with carbon and alumina to the top of a second gravity-fed, moving bed reactor; and (e) heating said charged second reactor to a temperature in the range of about 2000°-2200° C. to form aluminum-silicon alloy.

* * * * *

UNITED STATES PATENT AND TRADEMARK OFFICE

CERTIFICATE OF CORRECTION

PATENT NO. : 4,491,472

DATED : January 1, 1985

INVENTOR(S) : David T. Stevenson and Robert L. Troup

It is certified that error appears in the above-identified patent and that said Letters Patent is hereby corrected as shown below:

| | |
|---|---|
| Col. 3, line 4 | Change "moreover" to --Moreover--. |
| Col. 3, line 37 | Delete "silica", second occurrence. |
| Col. 10, line 13 | Change " "4+6 " to -- -4+6 --. |
| Col. 13, line 21 | Change "silicaon" to --silicon--. |

Signed and Sealed this

*Seventh* Day of *May 1985*

[SEAL]

*Attest:*

DONALD J. QUIGG

*Attesting Officer* *Acting Commissioner of Patents and Trademarks*